US006302117B1

(12) United States Patent
Tseng

(10) Patent No.: US 6,302,117 B1
(45) Date of Patent: Oct. 16, 2001

(54) NAIL FILE INCLUDING INNER AND OUTER HELICAL SPRINGS

(76) Inventor: Shao-Chien Tseng, No. 130, Sec. 2, Yang-Shin Rd., Yang-Mei, Taoyuan (TW)

( * ) Notice: Subject to any disclaimer, the term of this patent is extended or adjusted under 35 U.S.C. 154(b) by 0 days.

(21) Appl. No.: 09/614,478

(22) Filed: Jul. 11, 2000

(51) Int. Cl.[7] ..... A45D 29/04
(52) U.S. Cl. ..... 132/76.4
(58) Field of Search ..... 132/76.4, 73

(56) References Cited

U.S. PATENT DOCUMENTS

D. 203,793 * 2/1966 Leopoldi .
2,117,053 * 5/1938 Bickley ..... 132/76.4
4,757,571 * 7/1988 Young ..... 132/76.4 X

FOREIGN PATENT DOCUMENTS

677817 * 8/1952 (GB) ..... 132/76.4

* cited by examiner

*Primary Examiner*—Jeffrey A. Smith

(57) ABSTRACT

A nail file formed by providing an inner helical spring and an outer helical spring in a cover set; wherein, the outer helical spring is slipped over the inner helical spring to form an elastic inner filing member with an elastic toothed surface of multiple layers and bent to form a shape of an arciform new moon. The cover set is made of elastoplastics and includes an upper cover and a lower cover both in the shape of an arciform new moon. A user can press the cover set and the elastic inner filing member therein for elastic stretching and retracting the gaps in the elastic toothed surface of the elastic inner filing member, and can adjust the spaces of the gaps by screwing or unscrewing of a screw to suit filing of nails of various thickness at the positions of the outer and inner sharp edges to get rid of rough edges on the nails. Thereby efficiency, convenience and smoothness of nail filing can be largely increased.

5 Claims, 5 Drawing Sheets

NAIL FILE INCLUDING INNER AND OUTER HELICAL SPRINGS

BACKGROUND OF THE INVENTION

1. Field of the Invention

The present invention is related to a nail file, and especially to a nail file including an inner filing member of multiple layers with an inner helical spring and an outer helical spring and in the shape of an arciform new moon with a toothed surface exposed to be controlled by pressing for stretching and retracting. The nail file can be used for filing and trimming the nails of fingers or toes; it provides convenience and efficiency for nail filing.

2. Description of the Prior Art

Human and a majority of animals have fingers and toes of which the tissues have fibers, the fingers and toes can grow gradually. Specifically, the fingers and toes of pets that people keep are used to getting cut and trimmed in order not to hurt people and for keeping sanitation and good appearance.

In people's habit of nail trimming, in the first place, nail dippers are used to cut the nails that are overly long, then sheet like nail files are used to trim the nails to get rid of the rough edges on the cut areas; the ends of the nails thus are smoothly curved and are not subjected to hurt by scraping people, and they can look sanitary and can have good appearance.

However, conventional sheet like nail files specific for nail trimming are not ideal in use, this is because the fiber tissues of the nails after cutting are subjected to forming rough edges that are hurtful, especially those sharp rough edges formed at the top edges and bottom edges of the sectional surfaces of the cut nails (on the ends of the nails). And the sharp rough edges are distributed untidily on the sectional surfaces of the cut nails, so that in filing and trimming by the conventional sheet like nail files, the plane contact surfaces of the files and the end surfaces of the nails in the shapes of arciform new moons do not have sufficient spots or areas for filing. And thereby, the nail files must be all the way moved up and down or leftwards and rightwards in order to trim the rough edges to have the required smoothness to prevent them from hurting people. In view of these, a conventional sheet like nail file is lack of convenience in operation, a user even must get some technique for filing in order to obtain satisfied trimming of nails. In other words, people do not have suitable nail trimming tools after nail cutting to have the end surfaces of nails filed in order to get rid of the possibility of hurting people.

SUMMARY OF THE INVENTION

In view of the above defects of conventional sheet like nail files, the object of the present invention is to provide a nail file convenient for holding and largely increasing the efficiency of filing and trimming against the problems that nails of fingers and toes have different thickness and that the end surfaces of nails are in the shape of arciform new moons which are difficult to trim. And when the nails are cut, the rough edges on the end surfaces of nails can be trimmed to get smoothness.

The nail file of the present invention is designed to have a convex side and a concave side to be controlled by pressing for stretching and retracting, this is beneficial to being adapted to the shapes of arciform new moons of the end surfaces of nails of fingers or toes for contacting and eliminating the rough edges on the end surfaces of nails by means of an elastic toothed surface of an inner filing member between the convex and concave sides. In this way, efficiency and convenience of filing and trimming can be obtained.

The elastic toothed surface on the inner filing member of the nail file of the present invention can have its gaps between every two spring rings controlled for adjustment, so that the rough edges on the end surfaces of the nails of fingers or toes of different thickness simultaneously distributed in the gaps and are eliminated by filing with the elastic teeth.

In order to make the nail file of the present invention convenient for holding by a user to elastically control by pressing the tightness and curvature of the elastic arciform teeth layers between the convex and concave sides, a set of covers of the nail file is specifically made of elastomer (including elastoplastics and elastic rubber) capable of stretching and retracting to have the elastic inner filing member with the elastic toothed surface positioned. The nail file is further provided with a spring of predetermined strength to enhance the nature of elastic stretching and retracting controlled by pressing of the nail file.

The present invention will be apparent after reading the detailed description of the preferred embodiment thereof in reference to the accompanying drawings.

DETAILED DESCRIPTION OF THE PREFERRED EMBODIMENT

Figure 1:
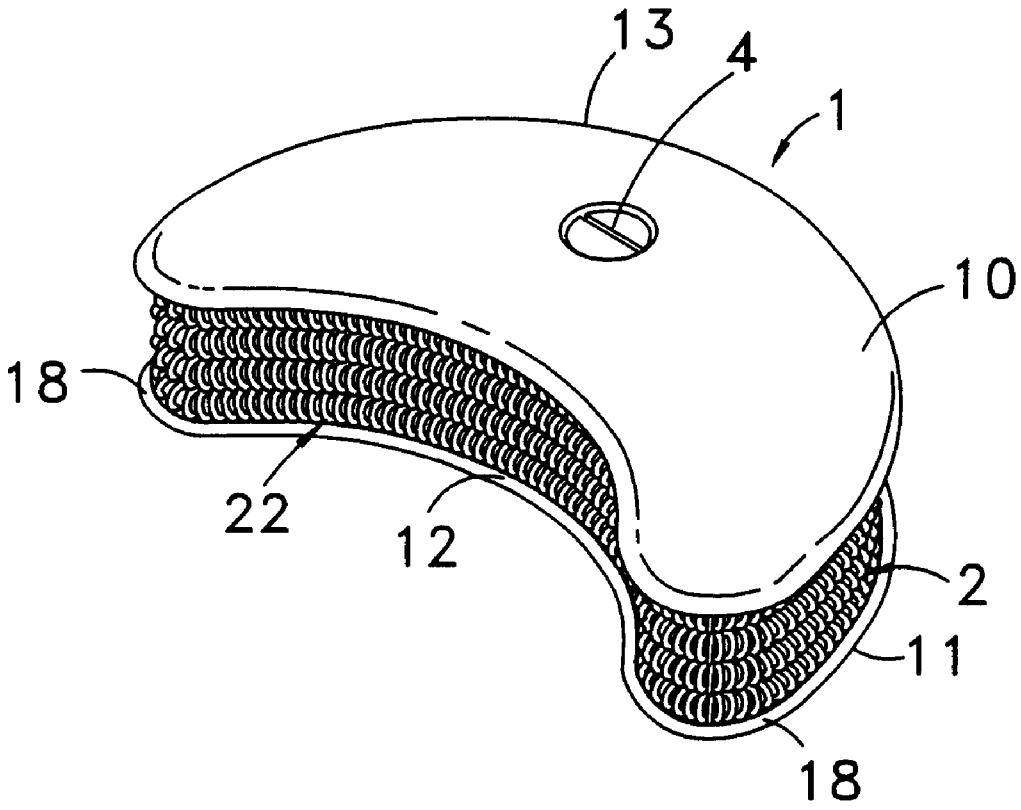
FIG. 1 is a perspective view showing the nail file of the present invention.
Figure 2:
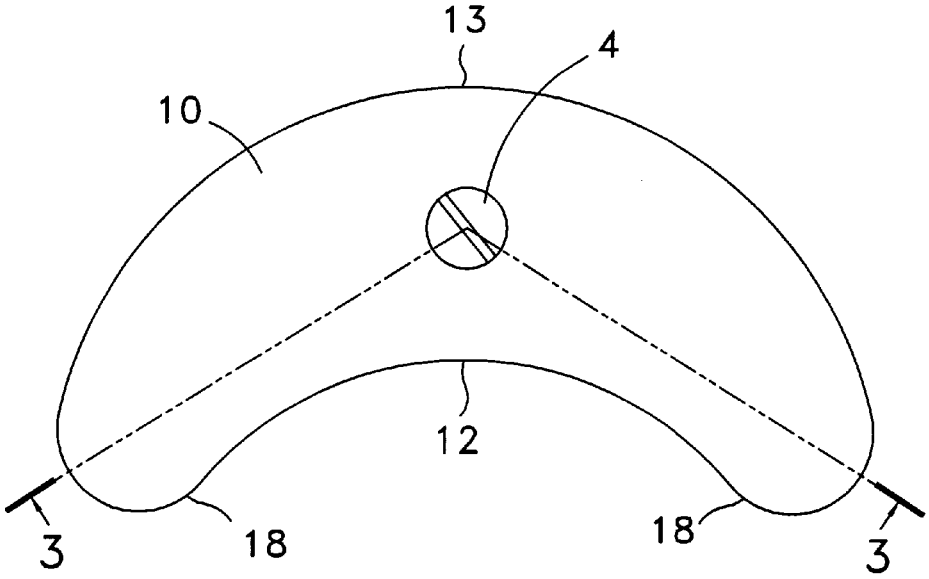
FIG. 2 is a top view of the nail file of the present invention.
Figure 3:
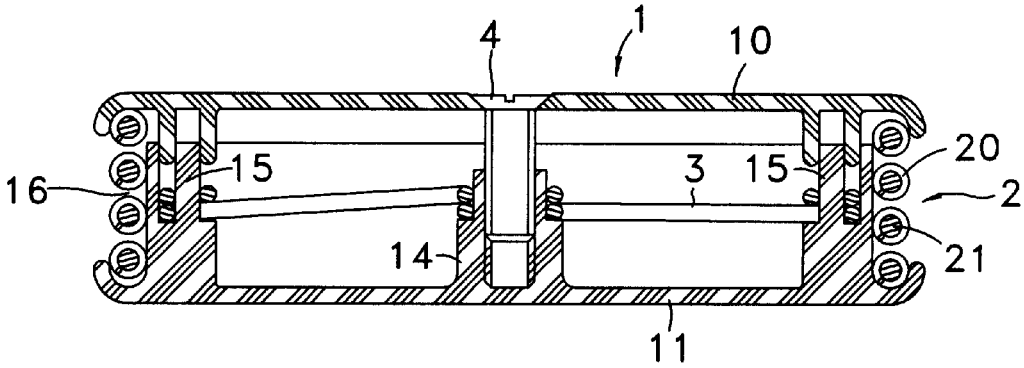
FIG. 3 is a sectional view from a section line 1—1 in FIG. 2.
Figure 4:
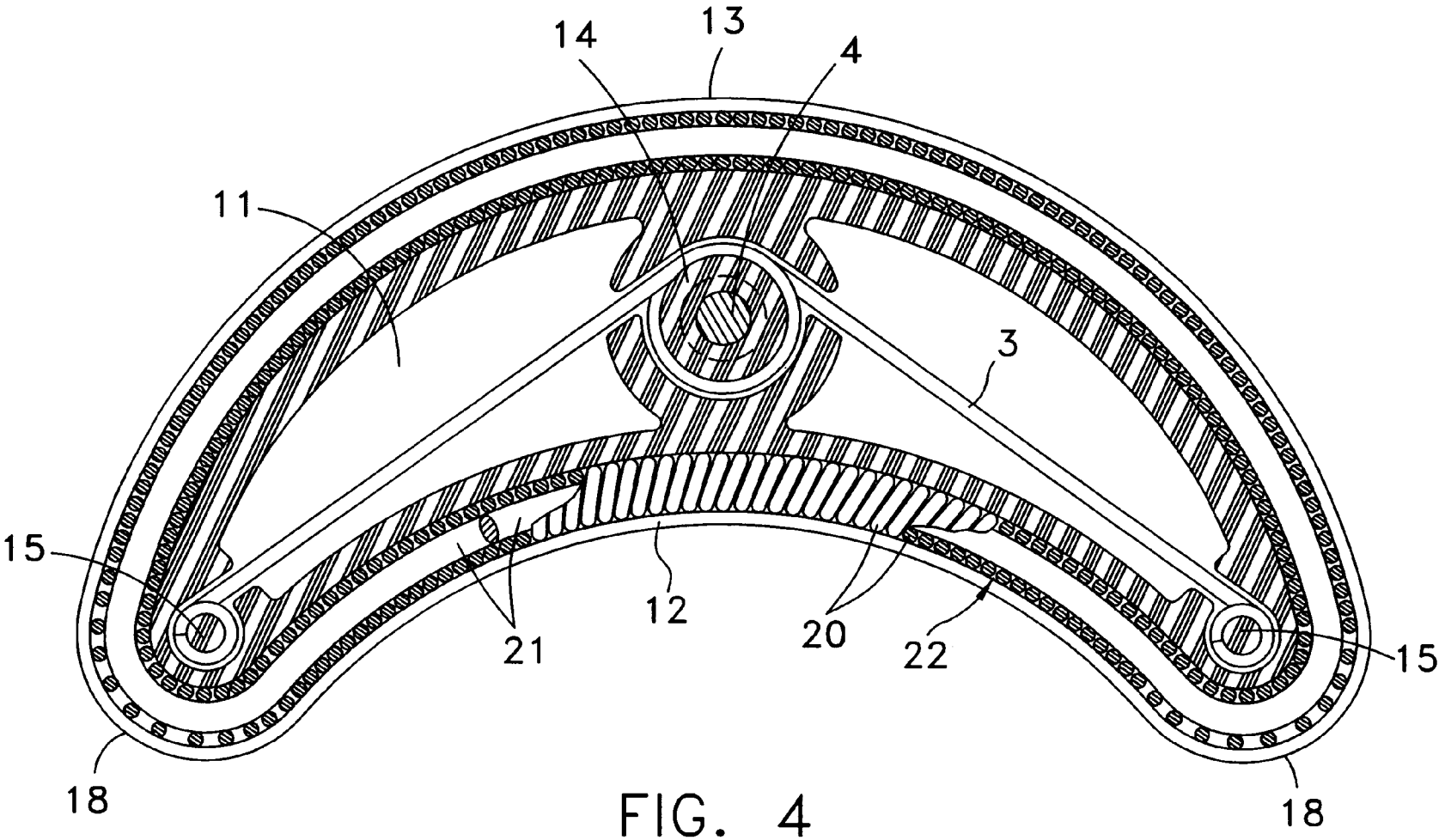
FIG. 4 is a sectional view showing another nail file of the present invention.

Referring firstly to FIG. 1 to 4, the nail file provided by the present invention is formed by providing an inner helical spring 21 and an outer helical spring 20 in a cover set 1; wherein, the outer helical spring 20 is slipped over the inner helical spring 21 to form an elastic inner filing member 2 with an elastic toothed surface 22 of multiple layers. The elastic inner filing member 2 is bent to form a shape of an arciform new moon (as shown in FIG. 1 and 4).

The cover set 1 is made of soft plastics including elastoplastics or elastic rubber and includes an upper cover 10 and a lower cover 11 (as shown in FIG. 1 and 3). The upper cover 10 and the lower cover 11 are both made in the shape of an arciform new moon, and are provided together with a concave side 12, a convex side 13 and two convex ends 18 on the two ends of both (referring to FIG. 2). The upper cover 10 and the lower cover 11 are assembled with a screw to sandwich the elastic inner filing member 2 therebetween, all the layers of the elastic toothed surface 22 are clamped in the concave side 12, the convex side 13 and two convex ends 18 on the two ends (as shown in FIG. 3 and 4).

The lower cover 11 is provided therein a central threaded seat 14 and two lateral supports 15. The threaded seat 14 can be screwed therein a screw 4 to lock the upper cover 10 thereon; a spring 3 of predetermined strength is provided between the central threaded seat 14 and the two lateral supports 15. The physical structure of the nail file thus is completed.

The wire of the inner helical spring 21 of the elastic inner filing member 2 preferably has a diameter ϕ0.95 mm, while the wire of the outer helical spring 20 preferably has a diameter ϕ0.18–0.22 mm, thereby, the soft and fine elastic toothed surface 22 having the function of scraping and filing on the end surfaces of the nails can be formed (as shown in FIG. 4).

Figure 5:
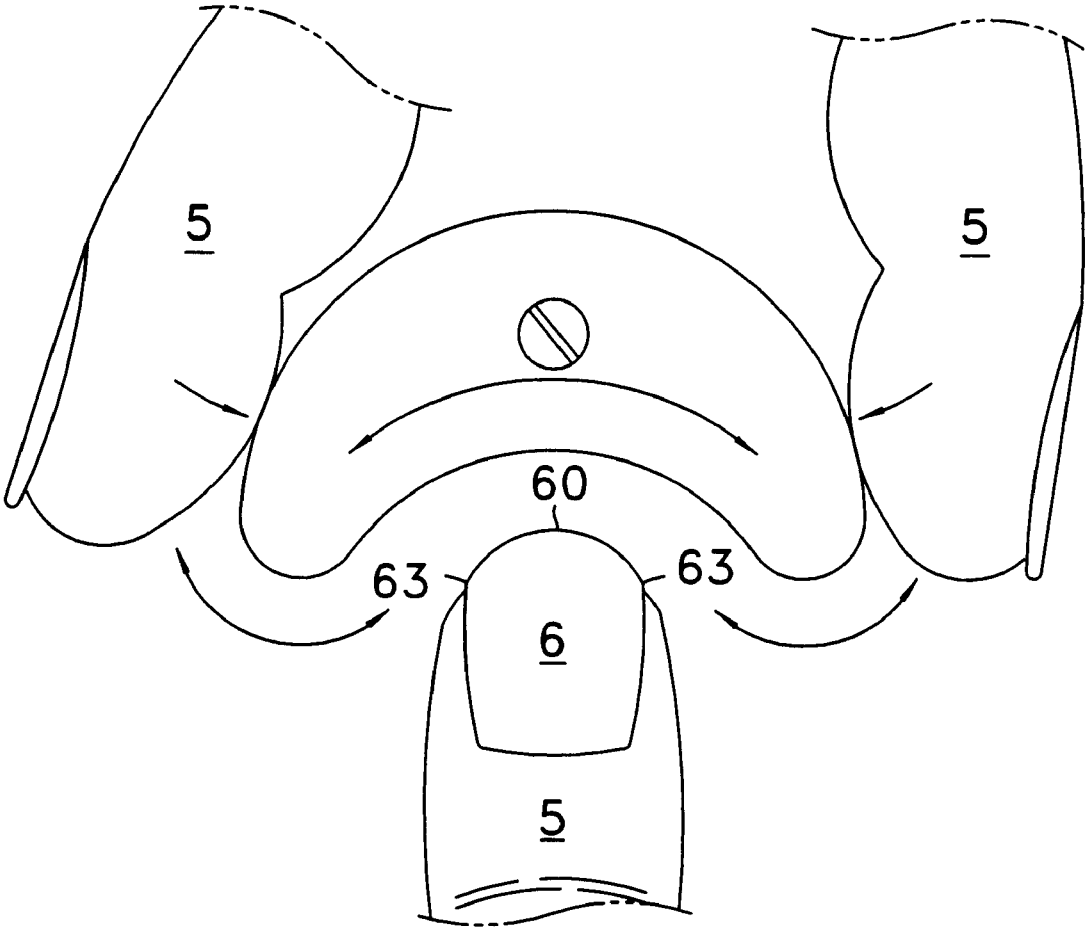
FIG. 5 is a schematic view showing the operation in use of the present invention.
Figure 6:
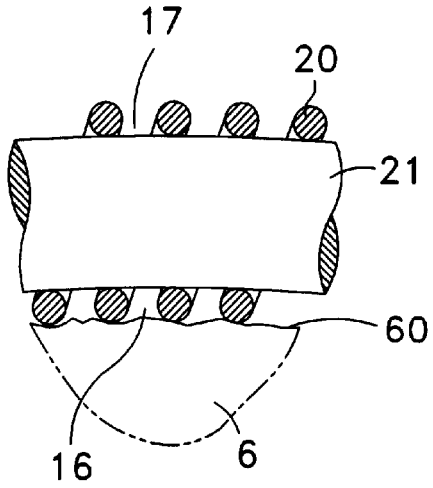
FIG. 6 is a partially enlarged schematic view showing contact filing of the sharp rough edges on the inner and outer surfaces of nails by means of an elastic toothed surface of the nail file of the present invention.

When in use, the elastic inner filing member 2 between the upper cover 10 and the lower cover 11 has elastic force, and is provided thereon with a spring 3 of predetermined strength, thereby, a user can press the two ends of the nail file in the shape of an arciform new moon with fingers 5 (as shown in FIG. 5), so that the gaps of teeth 16, 17 in the elastic toothed surface 22 between the concave side 12 and the convex side 13 are under control. That is, when the gaps of teeth 16, 17 get smaller, they provide a fine grinding function; and when the gaps of teeth 16, 17 get larger, they provide a coarse grinding function. Therefore, the end surface of a nail 6 with rough edges of different fineness can be ground and trimmed successfully (referring to FIG. 6).

As shown in FIG. 5, such operation of elastic controlling by pressing of fingers 5 can also control stretching and retracting of the curvature of the concave side 12 and the convex side 13 to meet the contours of the end surfaces 60 of nails of fingers or toes for contacting and eliminating the rough edges on the end surfaces of nails. In this way, an operation of synchronic soft filing for eliminating the rough edges at multiple spots on a nail on the end surface thereof can be effected.

Figure 7:
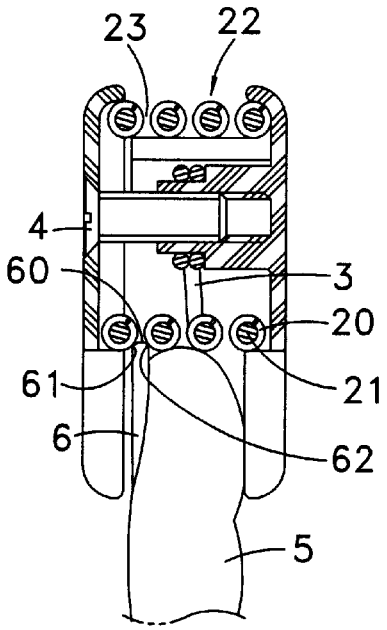
FIG. 7 is a sectional view showing the present invention being adapted to the thickness of a nail.

There are gaps 23 in the elastic toothed surface 22 of the elastic inner filing member 2. The spaces of the gaps 23 can be adjusted (as shown in FIG. 7), i.e., they can be adjusted by unscrewing or screwing tight the screw 4 to control the tightness of the inner filing member 2 between the upper cover 10 and the lower cover 11. Thereby, the gaps 23 can meet the thickness of a fingernail or toenail 6. A gap 23 on the elastic toothed surface 22 can synchronically file the outer sharp edge 61 and the inner sharp edge 62 of the nail 6 to smooth their rough edges.

Accordingly, the elastic toothed surface 22 on the concave side 12 of the nail file can operate under control to meet the contour of an end surface 60 of a nail, and the elastic toothed surface 22 on the convex side 13 and two convex ends 18 on the two ends of the nail file can rotationally file the two lateral corners 63 on the end surface 60 of the nail (as shown in FIG. 5). So that nail filing can be smooth, fast and convenient, the nail file is improved and has high efficiency and practicability. Having thus described the technical process of my invention.

What I claim as new and desire to be secured by Letters Patent of the United States are:

1. A nail file comprising an elastic inner filing member formed by slipping an inner helical spring in an outer helical spring, said elastic inner filing member is bent to form a shape of an arciform new moon, said elastic inner filing member thus is characterized by having an elastic toothed surface of multiple layers thereon.

2. A nail file as in claim 1, wherein, said elastic inner filing member is clamped between an upper cover and a lower cover both made in the shape of an arciform new moon, said upper cover and lower cover are provided together with a concave side, a convex side and two convex ends on the two ends of both to reveal said elastic toothed surface.

3. A nail file as in claim 2, wherein, said upper cover and lower cover are made of elastomer including elastoplastics or elastic rubber.

4. A nail file as in claim 2, wherein, said upper cover and lower cover are provided thereon with a screw to lock said upper cover and lower cover on said elastic inner filing member, and said screw is used to adjust gaps on said elastic toothed surface to suit filing of nails of various thickness.

5. A nail file as in claim 2, wherein, said two convex ends on said two ends of both said upper and lower covers are adapted for elastic pressing to control spaces of said gaps on said elastic toothed surface formed between said convex and concave sides, and to control stretching and retracting of said elastic toothed surface in meeting the shape of arciform new moon of an end surface of said nail by grinding and trimming.

* * * * *